US007527154B2

(12) United States Patent
Kara et al.

(10) Patent No.: US 7,527,154 B2
(45) Date of Patent: May 5, 2009

(54) STORAGE BIN FOR LETTERS AND FLAT PIECES OF MAIL

(75) Inventors: Karim Kara, Chabeuil (FR); Daniel Abraham, Soyons (FR); Christian Duclot, Ponsas (FR); Pierre Campagnolle, Etoile-sur-Rhone (FR)

(73) Assignee: Solystic, Gentilly Cedex (FR)

( * ) Notice: Subject to any disclaimer, the term of this patent is extended or adjusted under 35 U.S.C. 154(b) by 79 days.

(21) Appl. No.: 11/157,783

(22) Filed: Jun. 22, 2005
(Under 37 CFR 1.47)

(65) Prior Publication Data

US 2006/0113362 A1 Jun. 1, 2006

(30) Foreign Application Priority Data

Jun. 23, 2004 (FR) ..... 04 51192

(51) Int. Cl.
*B07C 5/00* (2006.01)

(52) U.S. Cl. ..... 209/630; 232/30

(58) Field of Classification Search ..... 209/630, 209/614; 220/507, 608, 669, 670; 229/120.02; 206/509, 511; 232/229–32, 43.2
See application file for complete search history.

(56) References Cited

U.S. PATENT DOCUMENTS

| | | | | |
|---|---|---|---|---|
| 3,343,725 | A * | 9/1967 | Cannon | 222/129 |
| 3,637,076 | A * | 1/1972 | Halopoff et al. | 209/704 |
| 5,233,814 | A | 8/1993 | Bergerioux et al. | |
| 5,290,025 | A * | 3/1994 | Plent et al. | 271/181 |
| 5,340,100 | A * | 8/1994 | Romanenko | 271/303 |
| 5,636,723 | A | 6/1997 | Bulle et al. | |
| 5,666,630 | A * | 9/1997 | Zoltner et al. | 399/405 |
| 6,227,536 | B1 | 5/2001 | Bethke | |
| 6,601,847 | B2 * | 8/2003 | Hendrickson et al. | 271/302 |

FOREIGN PATENT DOCUMENTS

| | | | |
|---|---|---|---|
| DE | 42 40 158 | C1 | 2/1994 |
| DE | 195 47 341 | A1 | 11/1998 |
| JP | 49-124378 | | 10/1974 |
| JP | 52-25732 | | 2/1977 |
| JP | 62502457 | T | 9/1987 |
| JP | 04-27734 | | 3/1992 |
| WO | WO86/06044 | * | 10/1986 |
| WO | WO 86/06044 | | 10/1986 |

* cited by examiner

*Primary Examiner*—Patrick H Mackey
*Assistant Examiner*—Kalyanavenkateshware Kumar
(74) *Attorney, Agent, or Firm*—Sughrue Mion, PLLC

(57) ABSTRACT

A storage bin for mail items comprises a plurality of side walls and a bottom. The bottom comprises two walls that are inclined one relative to the other, one of the two walls constituting a jogging wall for jogging the mail items into alignment in the bottom of the storage bin.

7 Claims, 4 Drawing Sheets

STORAGE BIN FOR LETTERS AND FLAT PIECES OF MAIL

The present invention relates to a storage bin for storing mail items, which bin comprises a plurality of side walls and a bottom.

More particularly, the invention relates to a storage bin for storing mail items, typically letters and flat pieces of mail, and used for receiving and storing mail items mainly in a postal sorting machine having conveyor buckets.

BACKGROUND OF THE INVENTION

In particular, in a postal sorting machine having conveyor buckets, the mail items are conveyed by a bucket carousel above a plurality of storage bins constituting sorting outlets of the sorting machine, and are dropped from the buckets into the storage bins merely by opening the bottoms of the buckets, as shown in U.S. Pat. No. 5,290,025.

Patent Document U.S. Pat. No. 6,648,284 discloses a storage bin for storing mail items. That bin has a bottom constituted by a wall inclined between two diametrically opposite corners of the bin, thereby enabling the mail items to be stacked better in the bottom of the bin, and enabling the stack of mail items in the bottom of the bin to be held in position better than with a bottom that is horizontal or perpendicular to the side walls of the bin.

Unfortunately, with that arrangement, the mail items (in particular open items like magazines) tend to bounce back off a side wall of the bin before being jogged into alignment in the bottom of the bin. More particularly, a mail item dropped into that type of bin tends to turn before it is jogged against a side wall of the bin, which can be detrimental to the remainder of the process of automatically sorting the mail item. In addition, the stability of the stack, and thus how well it stays together, is guaranteed only for flat mail items that are homogeneous, even though current sorting machines are required to sort mail items that are heterogeneous, i.e. of widely differing sizes. In addition, the arrangement of the bin known from the above-described document does not make it possible for the stack of mail items to be extracted automatically from the storage bin, which can be necessary during unstacking operations at the inlet of the sorting machine.

OBJECTS AND SUMMARY OF THE INVENTION

An object of the invention is to provide a mail storage bin that does not suffer from the above-mentioned drawbacks, and in particular that makes it possible to ensure that the longitudinal and the transverse directions of the mail items remain unchanged at the outlets of the buckets of the sorting machine, thereby making it possible to conserve the sequence of the mail items unloaded from the buckets into the bins, thereby making it possible to keep together the stack of mail items contained in the bin, including during automatic bin conveying and bin handling operations, and therefore enabling the mail items to be extracted automatically from the bin.

To this end, the invention provides a storage bin that is substantially rectangular block shaped for storing mail items in the sorting outlets of a postal sorting machine, said storage bin comprising a bottom surrounded by side walls defining a horizontal top portion of the bin and a horizontal bottom portion of the bin, wherein the bottom of the bin is made up of two inclined walls that, in section, form a V-shape having a base disposed in the bottom portion of the bin and branches that extend towards the horizontal top portion of the bin while being inclined relative to the horizontal bottom portion of the bin, and wherein the side walls of the bin flare going towards the bottom of the bin. It can thus be understood that the bin of the invention is designed to have a V-shaped internal bottom with internal walls that define the V-shape and that are inclined relative to the horizontal external bottom portion of the bin. The side walls (external walls) flare going from the top portion towards the bottom portion of the bin, thereby making it possible to stack the bins having V-shaped bottoms.

In a particular embodiment of the storage bin of the invention, relative to the horizontal, the ends of the two inclined walls are offset vertically.

In yet another particular embodiment, when the top portion of the bin is in the horizontal position, a first wall of the bottom forms an angle of about 40° relative to the horizontal, and a second wall of the bottom forms an angle of about 70° relative to the horizontal.

In yet another particular embodiment, one or both of the inclined walls of the bottom of the bin is/are perforated.

In yet another particular embodiment, one or both of the inclined walls of the bottom of the bin is/are undulating in profile.

In yet another particular embodiment, one of the inclined walls of the bottom of the bin has an undulating profile, and the other has a perforated profile.

In yet another particular embodiment, the bottom of the bin that is made up of the two inclined walls is removable relative to the side walls of the bin.

The invention also provides a postal sorting machine for sorting mail items, the machine having buckets for moving the mail items above a plurality of storage bins as defined above. Each mail item that leaves a bucket follows a path until it lands in a storage bin, one of the two inclined walls of a storage bin constituting a jogging wall for jogging the mail items into alignment in the bottom of the bin, and the other of the two inclined walls of the storage bin constituting a landing wall for receiving the mail items in the bottom of the bin. The jogging wall of the bin is inclined such as to be substantially tangential to the path of the mail item and the landing wall of the bin is inclined such that a mail item lands flat on it.

BRIEF DESCRIPTION OF THE DRAWINGS

A particular embodiment of the storage bin of the invention is described in more detail below and is shown in the drawings. The description is given merely by way of non-limiting indication. In the drawings.

MORE DETAILED DESCRIPTION

Figure 1:
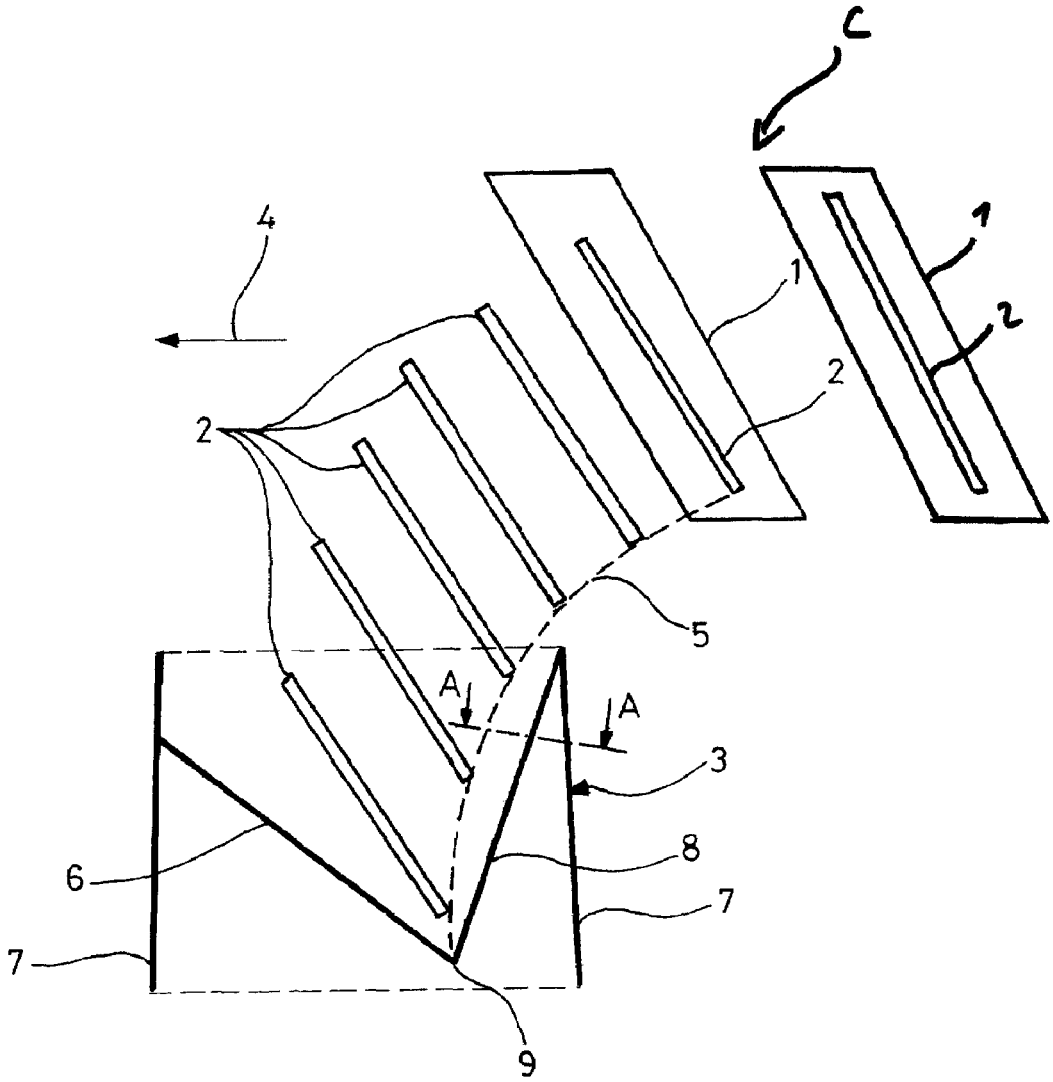
FIG. 1 is a diagrammatic section view of a storage bin of the invention receiving a mail item from a bucket in a sorting machine.

FIG. 1 shows a bucket 1 in a mail sorting machine. The bucket is conveying a mail item 2 above a storage bin 3 of the invention. The mail item 2 is placed in the bucket 1 in the length direction. It extends substantially vertically but at certain angle of inclination. The bucket 1 and therefore the mail item that it contains are, for example, inclined at 60° clockwise relative to the horizontal.

In a postal sorting machine, the buckets such as 1 move on a carrousel at a speed of about 1 meter per second (1 m/s), for example. FIG. 1 shows a horizontal arrow 4 going from right to left in order to indicate the movement of the bucket 1 above the stationary storage bin 3.

As it leaves the bucket 1 (the bottom of the bucket being open), the mail item 2, pushed by the bucket 1, describes a path 5 that is substantially parabolic and that is shown by a dashed line in FIG. 1 in association with the successive positions of the mail item 2 until it falls into the bottom of the storage bin 3. For a range of mail items of weights lying in the range less than 10 grams (g) to 3 kilograms (kg), approximately, and of widths lying in the range 90 millimeters (mm) to 300 mm, approximately, and of lengths lying in the range 100 mm to 400 mm, approximately, the path of the mail item 2 remains mainly dependent on the angular position and on the travel speed of the bucket 1.

The mail item 2 is thus received in the storage bin 3 on a landing wall referenced 6, which wall constitutes one of the walls of the bottom of the bin. The storage bin 3, which is substantially in the shape of a rectangular block, is made up of a plurality of side walls 7, e.g. four side walls 7, surrounding the bottom of the bin. The bottom of the bin of the invention is made up of two walls inclined relative to each other and relative to the horizontal (bottom portion and top portion of the bin when it is horizontal), namely the landing wall 6 and a jogging wall 8, the two walls forming a V-shape in section. The landing wall 6 and the jogging wall 8 corresponding respectively to the first and to the second branch of the V-shape. In FIG. 1, it can be seen that the internal walls of the bin that define the V-shaped bottom are inclined relative to the bottom portion of the bin (horizontal base shown as a dashed line) and relative to the top portion of the bin (horizontal opening shown as a dashed line).

More particularly, the landing wall 6 is inclined substantially identically to the bucket 1 so that the mail item 2 is received flat on the landing surface 6. Therefore, the mail item 2 does not bounce back and therefore does not change angular position on landing in the bottom of the bucket. The inclination of the landing wall 6 thus depends on the above-described path 5 and on the height from which the mail item 2 falls from the bucket 1. Attempts are made to minimize the height of fall of the mail items in order to avoid the mail items changing angular position as they fall, and, typically, the distance between the bottom of the bucket 1 and the top of the storage bin 3 is preferably equal to about 100 mm. In addition, the depth of the landing wall 6, i.e. the length of the first branch of the V-shape must be greater than the maximum mail item width for the range of mail items in question, e.g. 300 mm. However, the depth of the landing wall 6 must not be too large because a second mail item could then be received on the landing wall 6 above a first mail item that has landed previously. The second mail item could then slip under the first mail item, thereby constituting a risk of the stack falling apart. In addition, the base 9 of the V-shape must be placed substantially at the bottom of the bin, at the place where the mail item 2 comes into contact with the storage bin 3.

Experimentation has shown that a landing wall 6 inclined at about 40° relative to the horizontal satisfies the above-explained constraints.

The side wall 7 which extends the landing wall 6 towards the top of the bin forms an extension that makes it possible to increase the storage capacity of the bin 3.

In practice, the mail item 2 lands on the landing wall 6 and slides a little towards the base 9 of the V-shape to jog against the jogging wall 8.

The jogging wall 8 is inclined so as to be substantially tangential to the path of the mail item 2 where it lands in the V-shape 3. Thus, the mail item sliding on the landing wall 6 does not rise up the jogging wall 8. In a preferred embodiment of the invention, the jogging wall 8 extends from the base 9 of the V-shape to the top end of a side wall 7 and it is inclined at about 70° relative to the horizontal.

With such an arrangement of the storage bin of the invention, the mail item 2 lands flat against the landing wall 6 without its angular position being modified, and it jogs against the tangential wall 8 without rising up towards the top of the bin so that it is possible to constitute a stack of mail items that is stable and that stays together in the bottom of the bin, which bin can be conveyed automatically or can be handled without any risk of the stack falling apart.

In addition, the mail items are stacked on edge in the bottom of the bin, thereby making it easy to check the contents of the storage bin.

Figure 2:
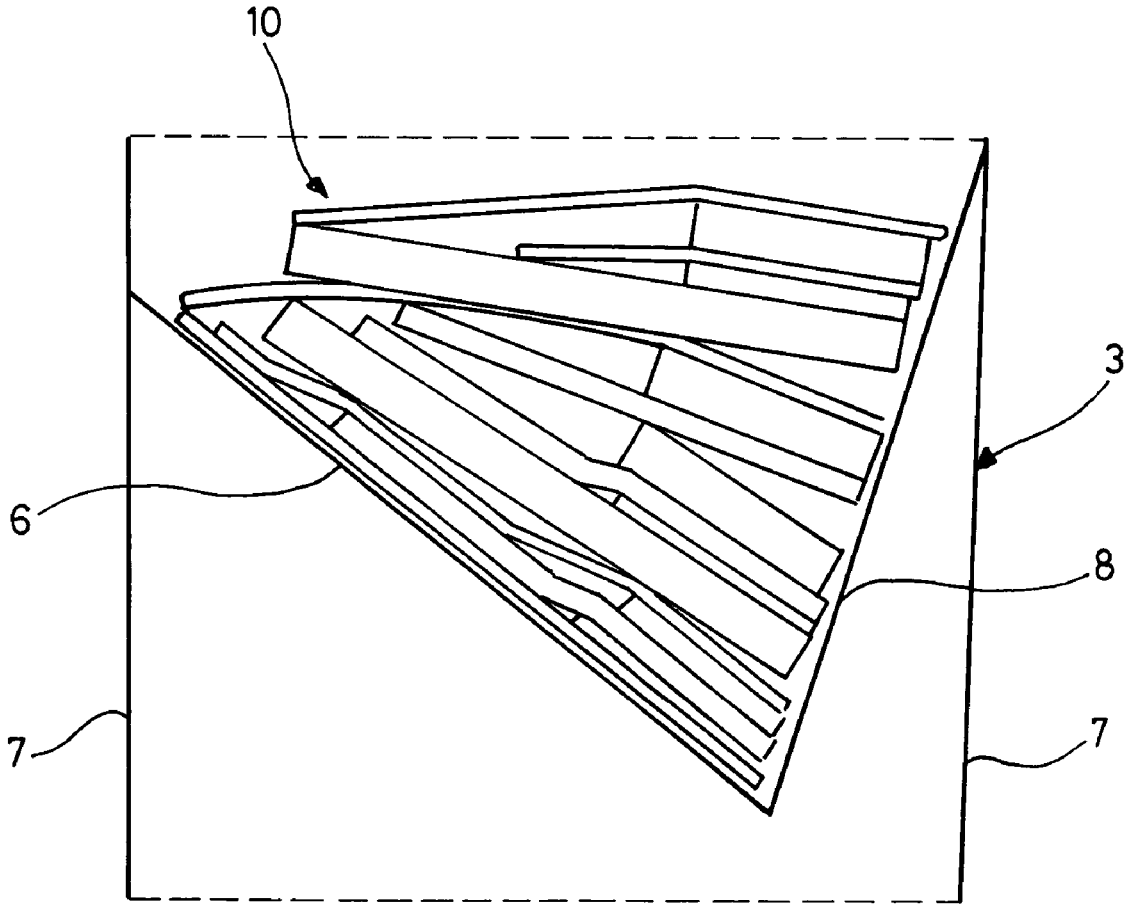
FIG. 2 is a diagrammatic section view of a storage bin of the invention containing a plurality of heterogeneous mail items stacked in the bottom of the bin.

FIG. 2 shows a plurality of heterogeneous mail items 10 in the bottom of the storage bin 3. It can be understood that by jogging against the jogging wall 8, the successive heterogeneous mail items form a stack 10 that is increasingly flat as the number of mail items increases. The height of the stack 10 is equivalent to the length of a straight line segment that is perpendicular to the landing wall 6 and that extends to the top of the stack 10. A stack height of about 230 mm makes it possible to have a stack 10 that is sufficiently stable for automatic conveying, and a bin 3 that offers satisfactory storage capacity.

A larger storage capacity can be obtained for the bin 3 by means of a storage bin 3 that is larger and by means of a device making it possible to adjust the position of the bottom of the bin 3, which bottom is made up of the landing wall 6 and of the jogging wall 8, and therefore to adjust the height through which the mail items fall as the mail items are being stacked up in the bin 3, so that the height of fall is maintained at a correct value, thereby avoiding changes in angular position of the mail items.

Figure 3:
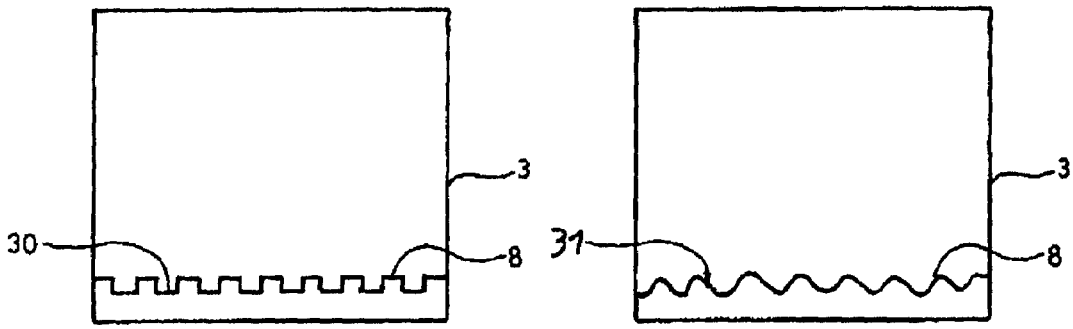
FIG. 3 shows a section view on A-A in FIG. 1 of the storage bin of the invention with two sloping walls that constitute the bottom of the bin and that are crenellated or undulated in profile.

FIG. 3, is a section view on A-A in FIG. 1 of the storage bin 3, in which the jogging wall 8 has a crenellated shape 30 or a undulated shape 31 in profile. In a preferred embodiment of the invention, the landing wall 6 also has a crenellated shape in profile. By way of example, the crenellated profile 30 makes it possible to use a device constituted by extraction fingers (not shown in the figure) to pass under the stack of heterogeneous mail items 10 and thus to extract the mail items while also keeping the stack 10 together. The example of the automatic or manual extraction process can be implemented between the first sorting pass and the second sorting pass in the sorting machine, or during transfer from the bin to a bin dedicated to delivery.

In a particular embodiment of the storage bin 3 of the invention, the profile of the landing wall 6 and/or of the jogging wall 8 can be an undulating profile associated with a suitable extraction device.

Figure 4:
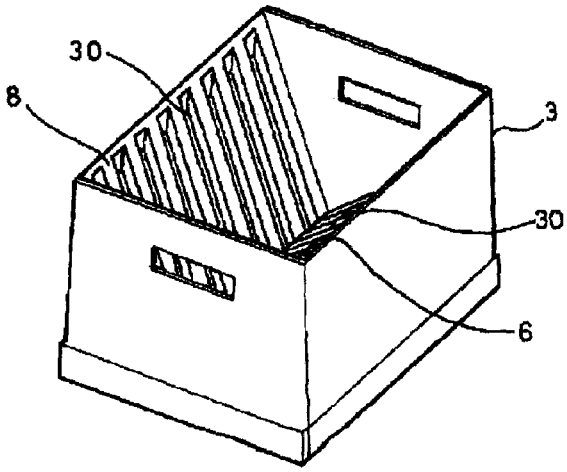
FIG. 4 is a perspective view of the storage bin of the invention with sloping walls that constitute the bottom of the bin and that are crenellated in profile.

FIG. 4 is a perspective view of a storage bin 3 in which the landing wall 6 and the jogging wall 8 have crenellated profiles 30. In FIG. 4, it can also be seen that the external side walls of the bin flare going from the top portion (opening) towards the bottom portion (bottom) of the bin.

Figure 5:
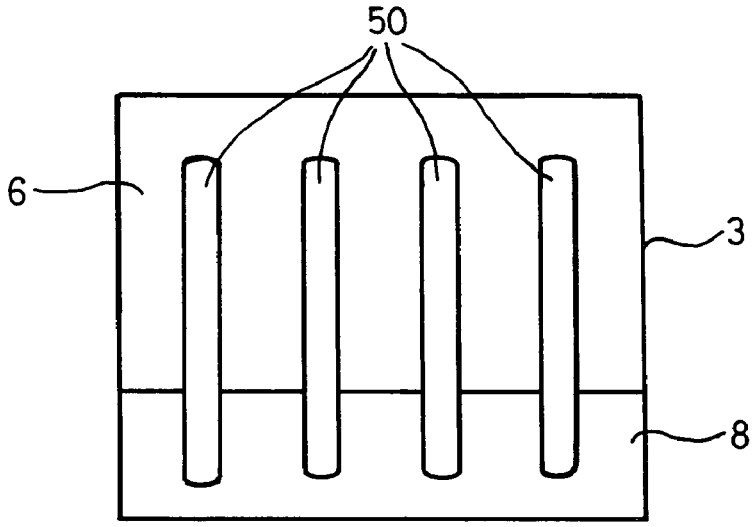
FIG. 5 is a plan view of the storage bin of the invention with perforated sloping walls that constitute the bottom of the bin.

FIG. 5 is a plan view of the storage bin 3, in which the landing wall 6 and the jogging wall 8 are perforated by means of a plurality of slots 50 extending from the landing wall 6 to the jogging wall 8, e.g. so that a device constituted by extraction fingers (not shown in the figure) makes it possible to extract the stack of heterogeneous mail items 10 automatically or manually while keeping the stack 10 together.

Figure 6:
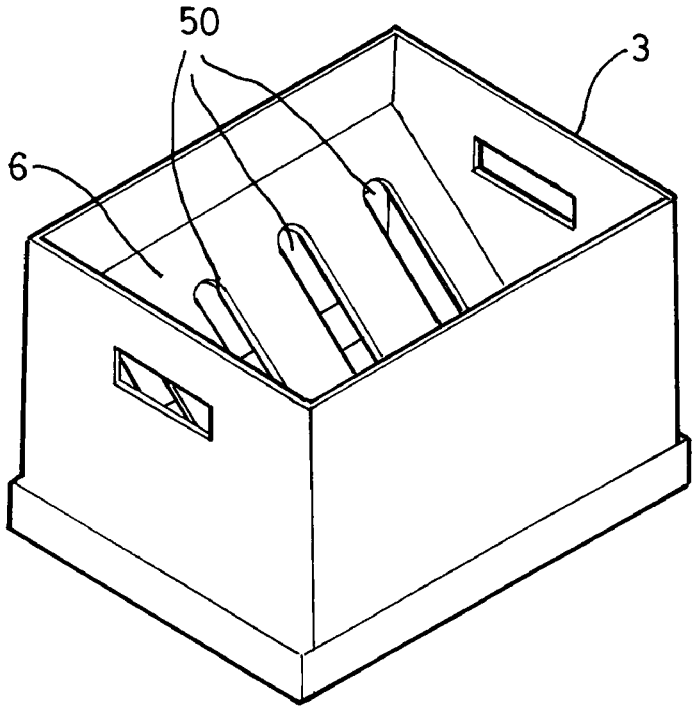
FIG. 6 is a perspective view of the storage bin of the invention with perforated sloping walls that constitute the bottom of the bin.

FIG. 6 is a perspective view of the storage bin 3 in which the landing wall 6 and the jogging wall 8 are perforated by means of a plurality of slots 50 extending from the landing wall 6 to the jogging wall 8.

In a particular embodiment of the storage bin 3 of the invention, the landing wall 6 and the jogging wall 8 can be such that one of them has a perforated profile and the other has an undulating profile.

In a preferred embodiment of the storage bin 3 of the invention, the side walls 7 flare going towards the bottom of the storage bin 3. Therefore, when the storage bins are not in use, they can be stacked by nesting in one another, thereby minimizing the amount of space required for them.

In a particular embodiment of the storage bin 3 of the invention, a bar code is written on the storage bin 3 in order to identify it, and in order to make it possible to monitor the sequence of the storage bins in the sorting machine.

In another particular embodiment of the storage bin 3 of the invention, the bottom of the storage bin 3 made up by the landing wall 6 and by the jogging wall 8 is a removable bottom suitable for being put into place in a storage bin having a flat bottom, for example.

What is claimed is:

1. A postal sorting machine for sorting flat mail items comprising storage bins and a bucket carousel with buckets for conveying mail items above a plurality of storage bins, characterized in that said buckets are each extending vertically with an inclination of approximately 60° relative to the horizontal, in that each storage bin is substantially rectangular block shaped with an opened top portion and a bottom portion surrounded by outside walls which flare from said top portion towards said bottom portion, in that said bottom portion of each storage bin comprises two inclined inside walls that in section form a V-shape when said storage bin is disposed with said top portion extending substantially horizontally under said moving buckets, one of said inclined inside walls constituting a jogging wall inclined at approximately 70° relative to the horizontal against which an edge of a mail item is coming into alignment in the bottom of the bin and the other of said inclined inside walls constituting a landing wall inclined at approximately 40° with respect to the horizontal along which a mail item is landing flat in the bottom of the bin, and in that each storage bin is disposed horizontally with respect to an inclined bucket moving above said storage bin so that a mail item which is leaving by gravity said bucket with a certain angular position is landing flat on said landing inclined wall of said storage bin after following a parabolic path without its angular position being modified and being jogged on edge against said jogging inclined wall of said storage bin.

2. A. postal sorting machine according to claim 1, in which the two inclined inside walls of said bottom portion of a storage bin comprise two upper ends which are vertically offset relative to one another.

3. A. postal sorting machine according to claim 1, in which, when the top portion of a storage bin is in the horizontal position, a first inclined inside wall of the bottom portion forms an angle of about 40° relative to the horizontal, and the second inclined inside wall of the bottom portion forms an angle of about 70° relative to the horizontal.

4. A postal sorting machine according to claim 1, in which one or both of the inclined inside walls of the bottom portion of the bin is/are perforated.

5. A postal sorting machine according to claim 1, in which one or both of the inclined inside walls of the bottom portion of the bin is/are undulating in profile.

6. A postal sorting machine according to claim 1, in which one of the inclined inside walls of the bottom portion of the bin has an undulating profile, and the other inclined inside wall has a perforated profile.

7. A postal sorting machine according to claim 1, in which the bottom portion of a bin is removable relative to the outside walls of the bin.

* * * * *